US007533633B2

(12) United States Patent
Becker et al.

(10) Patent No.: US 7,533,633 B2
(45) Date of Patent: May 19, 2009

(54) ESTABLISHING A CONNECTION BETWEEN STEAM GENERATOR HEATING SURFACES AND A COLLECTOR AND/OR DISTRIBUTOR

(75) Inventors: Martin Becker, Leverkusen (DE); Dietmar Hettkamp, Hünxe (DE); Ralf-Udo Husemann, Ratingen (DE)

(73) Assignee: Hitachi Power Europe GmbH, Oberhausen (DE)

( * ) Notice: Subject to any disclaimer, the term of this patent is extended or adjusted under 35 U.S.C. 154(b) by 92 days.

(21) Appl. No.: 11/631,746

(22) PCT Filed: Jul. 4, 2005

(86) PCT No.: PCT/DE2005/001174

§ 371 (c)(1),
(2), (4) Date: Jan. 24, 2007

(87) PCT Pub. No.: WO2006/005306

PCT Pub. Date: Jan. 19, 2006

(65) Prior Publication Data

US 2007/0221144 A1 Sep. 27, 2007

(30) Foreign Application Priority Data

Jul. 5, 2004 (DE) ..... 10 2004 032 611

(51) Int. Cl.
*F22B 37/10* (2006.01)

(52) U.S. Cl. ..... 122/511; 122/DIG. 16; 285/288.1

(58) Field of Classification Search ..... 122/511, 122/367.3, DIG. 13, DIG. 14, DIG. 16; 110/325; 228/164–172, 173.4, 173.5; 285/288.1; 219/137 R, 219/137 WM See application file for complete search history.

(56) References Cited

U.S. PATENT DOCUMENTS 1,889,874 A * 12/1932 Obert ..... 285/189
2,203,357 A * 6/1940 Kerr ..... 122/365
2,216,033 A * 9/1940 Hopkins ..... 228/189

(Continued)

FOREIGN PATENT DOCUMENTS

GB 466 256 A 5/1937

(Continued)

OTHER PUBLICATIONS

International Search Report.

*Primary Examiner*—Gregory A Wilson
(74) *Attorney, Agent, or Firm*—Collard & Roe, P.C.

(57) ABSTRACT

The invention relates to the establishing of a connection between steam generator heating surfaces made of austenitic materials and a collector and/or distributor made of martensitic or ferritic materials or of a nickel-base alloy. In order to extend the expectation of serviceable life of the connection, the pipe nipple of the reservoir used as a collector or distributor is made of a nickel-base alloy and directly welded to the collector wall in such a manner that an axial gap remains between the connecting branch and the collector wall. In a connection of the aforementioned type between steam generator heating surfaces made of austenitic materials and the pipe nipple or the pipe nipple and the collector made of martensitic materials, the coefficient of expansion of the material of the pipe nipple has a particularly good effect upon the serviceable life of the entire connection.

5 Claims, 3 Drawing Sheets

U.S. PATENT DOCUMENTS

| | | | | | |
|---|---|---|---|---|---|
| 2,271,652 | A | * | 2/1942 | Langvand et al. | 122/365 |
| 4,130,931 | A | * | 12/1978 | Norcross | 29/527.5 |
| 4,398,867 | A | * | 8/1983 | Dernedde et al. | 415/213.1 |
| 4,444,157 | A | * | 4/1984 | Worley | 122/510 |
| 4,505,420 | A | | 3/1985 | Wittenbach | |
| 4,526,137 | A | | 7/1985 | Garrison et al. | |
| 4,579,171 | A | * | 4/1986 | Stafford et al. | 165/115 |
| 4,777,911 | A | * | 10/1988 | Wepfer | 122/512 |
| 5,775,269 | A | * | 7/1998 | Lawrence | 122/511 |
| 5,950,575 | A | * | 9/1999 | Simons et al. | 122/511 |
| 5,957,507 | A | * | 9/1999 | Asada | 285/189 |
| 7,011,343 | B1 | * | 3/2006 | Shah | 285/288.1 |
| 2003/0051779 | A1 | | 3/2003 | Harth et al. | |

FOREIGN PATENT DOCUMENTS

| | | | |
|---|---|---|---|
| GB | 678 549 | A | 9/1952 |
| GB | 905 419 | A | 9/1962 |
| NL | 84 739 | C | 4/1957 |

* cited by examiner

ESTABLISHING A CONNECTION BETWEEN STEAM GENERATOR HEATING SURFACES AND A COLLECTOR AND/OR DISTRIBUTOR

CROSS REFERENCE TO RELATED APPLICATIONS

Applicants claim priority under 35 U.S.C. §119 of German Application No. 10 2004 032 611.8 filed Jul. 5, 2004. Applicants also claim priority under 35 U.S.C. §365 of PCT/DE2005/001174 filed Jul. 4, 2005. The international application under PCT article 21(2) was not published in English.

BACKGROUND OF THE INVENTION

1. Field of the Invention

The invention relates to a process for establishing a connection between steam generator heating surfaces made of an austenitic material and a vessel employed as a collector or distributor including a basic body of ferritic or martensitic material. The invention also relates to a vessel conceived as a collector or distributor including pipe nipples for connecting to a heating surface of a steam generator.

2. Description of the Invention

In modern steam generators operating at high pressures and high temperatures some of the heating surfaces of the superheater and intermediate superheater are made of austenite materials. The austenite materials have an adequate strength, corrosion and oxidation resistance at such high pressures and temperatures for the purpose of employment with such heating surfaces. On the other hand, outside of the heated space, that is to say, outside of the combustion and radiation space martensitic or ferritic materials are employed. This applies in particular also to the collectors and distributors, which are positioned in the unheated region and to which the connecting ducts are connected which are likewise produced from austenitic material.

However, the austenitic materials have a higher coefficient of expansion than martensitic or ferritic materials. This results in high stresses at the welded connecting localities between materials of austenitic materials (so-called "white materials") and those of ferritic or martensitic materials, (so-called "black materials"). Conventionally, so-called black-white-connectors are employed which, in the example according to FIG. 3, are produced from two axially welded together pieces of piping formed of appropriate different materials and which are welded in the unheated region into the connecting ducts 15 (cf FIGS. 1 and 2) from the heated surface to the collector 17 or immediately preceding the collector 17 between the connecting ducts 15 and the collector nipples 16. It is also known to provide such weld connectors on the boiler side between the heating surface outlet and connecting ducts leading to the collector.

Such black-white connectors, because they are subject to increased quality requirements, can only be manufactured and tested at high cost. Moreover, when installing the black-white connectors, several welding seams are needed in the connecting ducts leading to the collector, whereby, in turn, the assembly and testing costs are further increased.

SUMMARY OF THE INVENTION

The invention provides a process and a collector or distributor fitted with nipples of the aforesaid type by which the assembly and testing expenses are reduced, as well as inherent and operational stress conditions are reduced, whereby the life expectancy for the connection between the steam generator heating surfaces and the collector or distributor is increased substantially.

In the process according to the invention for the manufacture of a connection between steam generator heating surfaces made of an austenitic material and a vessel employed as a collector or distributor, having a basic body made of martensitic or ferritic material, pipe nipples made of a nickel-based alloy are installed between the connecting ducts leading to the heating surface, and the vessel wall of the basic body and the pipe nipples are directly welded to the vessel wall of the basic body in such a manner that between the pipe nipples and the vessel wall an axial gap is retained.

In the case of a vessel according to the invention conceived as a collector or distributor the pipe nipples for connecting to the connecting ducts leading to the heating surfaces or steam generator tubes of a steam generator, are made of a nickel-based alloy and are so inserted into the wall of the basic body of the vessel and welded directly to the vessel wall, that between the pipe nipples and the bottom of the outer region of the connecting wall an axial gap is retained.

Due to the invention the connecting ducts to the steam generator heating surfaces of austenitic and, therefore, "white" material, may be welded directly to the respective vessel pipe nipples made of a nickel-based alloy which has a co-efficient of expansion intermediate between the co-efficient of expansion of austenitic, i.e. white material, and the co-efficient of expansion of ferritic or martensitic, i.e. black material. Moreover, the pipe nipples made of a nickel-based alloy are welded directly to the vessel wall so that the transitional welding seam from the nickel-based alloy of the pipe nipples to the material of the vessel wall is positioned directly at the transition from the vessel basic body to the vessel pipe nipples. Because the pipe nipple of a nickel-based alloy is inserted into the vessel wall in such a manner than an axial gap or free space is left between the pipe nipple and the vessel wall, a substantially improved stress distribution is attained in the region of the welding seam.

Compared with the conventional use of black-white connectors in the connecting ducts between the heating surface of the steam generator and the collector or distributor, up to two welding seams, depending on construction, are dispensed with due to the invention, whereby expenditures on assembly, testing and maintenance are substantially reduced, bearing in mind that the transitional welding seam from the "white material", of which the connecting ducts as well have been manufactured, to the "black material", is positioned directly on the wall of the collector or distributor Axial gaps between a pipe end and a wall are known per se from the regulatory ASME-Manual (so-called ASME-welding seams), an insert being inserted between the pipe end and the wall, being decomposed or destroyed during the operation of the plant, so that the actual gap remains. This procedure may also be adopted when producing the welding seam according to the invention. However, it is also possible to retain open the actual gap acting as an expansion joint in a different manner, e.g. by the formation of suitable projections or the like formed on the pipe end and/or the wall and which, during the operation of the plant, become squashed due to the expansion of the pipe nipple. The elastic and plastic deformations of the pipe nipple are compensated for by the axial gap.

The width of the axial gap depends on the difference between the pipe nipple and the vessel wall as regards their expansion characteristics, which, in turn, is in particular dependent on whatever material has been used. The width of the axial gap lies in the range of several tenths of millimeters up to several millimeters, for example, at 1,6 mm prior to welding in the case of a nipple outer diameter in the range of 40 to 80 mm.

As a welding material for the welding seam between the pipe nipple and the wall of the vessel, a material is likewise preferably used according to the invention the co-efficient of expansion of which is of an order of magnitude intermediate between the co-efficient of expansion of the nickel-based alloy of which the pipe nipple has been manufactured and the co-efficient of expansion of the material of the vessel wall of ferritic or martensitic material. Thereby the stress condition in the region of the welding seam is additionally influenced favorably.

The nickel-based alloys (e.g. alloy 617) used according to the invention as materials for the nipples, are characterized by a thermal expansion co-efficient which lies between the expansion co-efficient of ferritic or martensitic material and the expansion co-efficient of austenitic material.

Preferably, also for the weld connection between the pipe nipples and connecting duct of austenitic material a welding material is employed the co-efficient of expansion of which lies in a range intermediate between the co-efficient of expansion of the nipple material and the co-efficient of expansion of the material of the connecting duct, or there is likewise used a welding material made of a nickel-based alloy.

In a further development of the inventive concept, a nickel-based alloy the co-efficient of expansion of which has a value intermediate between that of austenitic material and ferritic or martensitic material, is likewise used as a material for the basic body of the vessel serving as a collector or distributor instead of a ferritic or martensitic material, the pipe nipples likewise being made of a nickel-based alloy having a co-efficient of expansion intermediate between that of austenitic material on the one hand and that of martensitic or ferritic material on the other hand, and are welded directly onto the vessel wall.

In this embodiment as well in which the vessel wall itself is composed of a nickel-based material, an axial gap is left open between the pipe nipple and the bottom of the outer region into which the pipe nipple is inserted, being particularly effective to compensate against the elastic and plastic deformations of the nipples during welding and in particular also during the operation of the plant, in which case in this embodiment the axial gap may, however, optionally be smaller than in the case of a vessel wall of ferritic or martensitic material.

A further embodiment of the invention concerns a process for the establishment of a connection between steam generator heating surfaces of an austenitic material and a vessel employed as a collector or as a distributor, having a basic body of a martensitic or ferritic material, wherein pipe nipples of a nickel-based alloy are installed between the connecting lines of an austenitic material, leading to the heating surfaces and the vessel wall of the basic body and wherein the pipe nipples at one end are directly welded to the vessel wall and at the other end, each to a connecting duct. Preferably, a welding material is used for welding the pipe nipple and the vessel wall or the pipe nipple and the connecting duct together a welding material that has a co-efficient of expansion with a magnitude between the co-efficient of expansion of the nipple material and the co-efficient of expansion of the vessel material or of the connecting duct. For welding the pipe nipples and the vessel wall together or the pipe nipple to the connecting duct, it is also possible to employ a welding material having a co-efficient of expansion that corresponds to that of the pipe nipple. After welding together the components pipe nipple and vessel wall or pipe nipples and connecting ducts, the co-efficient of expansion of the welding connection, because of the mixing together of the respective materials will lie between the co-efficient of expansion of the two materials to be connected. The welding material for the welding together of the pipe nipples and the vessel wall may be different from that for welding together the pipe nipple and the connecting duct. In this embodiment of the process according to the invention as well, an axial gap is preferably kept open between the pipe nipple and vessel wall, which is effective for compensating the elastic and plastic deformation of the nipple during welding and, in particular, also during operation of the plant.

The nickel-based alloy of which the vessel wall is manufactured, may correspond to that of which the pipe nipples are manufactured. The pipe nipples and vessel wall may, for example, both be made of the alloy 617. However, it is also possible to employ for the vessel wall a nickel-based alloy different from that for the pipe nipples, more particularly having a co-efficient of expansion which is intermediate between that of the nipple material and that of the martensitic or ferritic materials.

Likewise, as the welding material for the welding together of the pipe nipples to a vessel wall of a nickel-based alloy, a material of a nickel-based alloy is employed. If the nipple material and the wall material have the same thermal co-efficient of expansion, a welding material of the same type is employed. However, if these expansion coefficients are different, a welding material is preferably employed having an expansion co-efficient between those of the nipple material and of the wall material.

For welding together the pipe nipples to the respective connecting duct to the heating surface of the steam generator, in this modification of the invention as well comprising a vessel wall made of a nickel-based alloy, a welding material is employed, the co-efficient of expansion of which is in a range intermediate between the co-efficient of expansion of the nipple material and the co-efficient of expansion of the material of the austenitic connection line, or a welding material of a nickel-based alloy is employed which corresponds to the nickel-based alloy of which the pipe nipples are manufactured. Optionally, the welding material for welding the connecting ducts to the pipe nipples may correspond to that which is also used for welding the pipe nipples into the vessel wall.

BRIEF DESCRIPTION OF THE DRAWINGS

In the drawing there is shown in

DETAILED DESCRIPTION OF PREFERRED EMBODIMENTS

Figure 1:
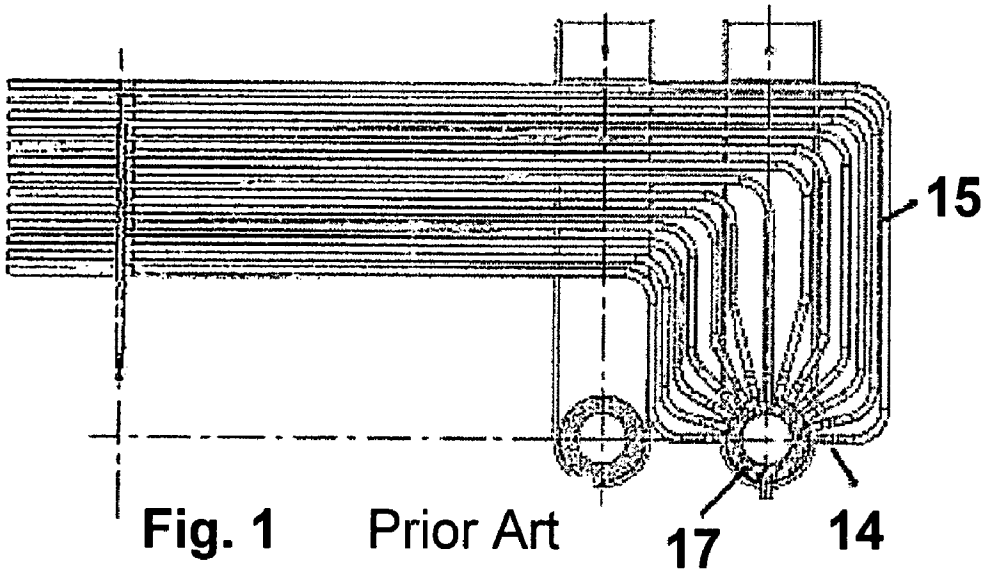
Fig. 1 Prior Art
FIG. 1 schematically the unheated region of a steam generator with connecting ducts 15 between heating surfaces and collector nipples, collector 17 and conventional welding connectors 14 welded into the connection between connecting ducts 15 and collector 17.
Figure 2:
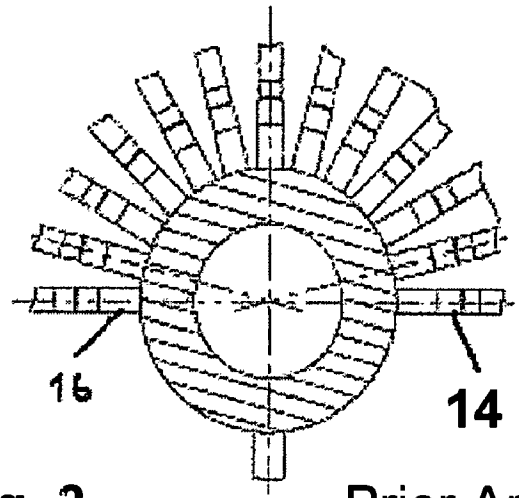
Fig. 2 Prior Art
FIG. 2 shows in a schematic longitudinally sectional view a conventional collector 17 with conventional black-white connectors 14, welded to the collector nipples 16, and in FIG. 3 an example is shown of a black-white connector 14.
Figure 3:
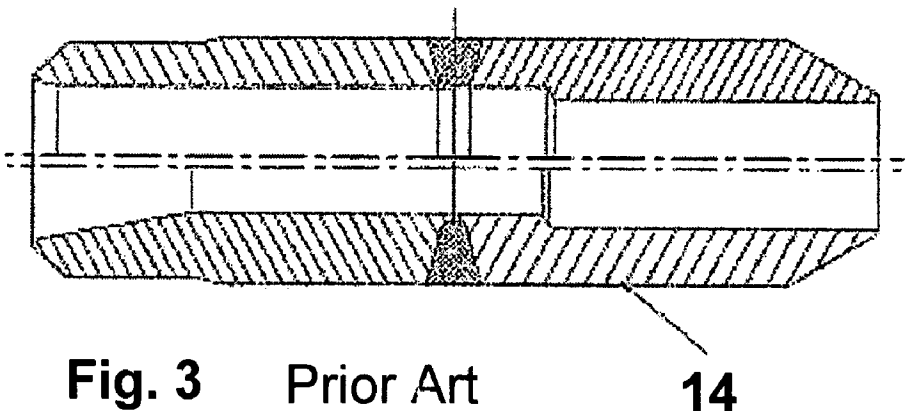
Fig. 3 Prior Art
Figure 5:
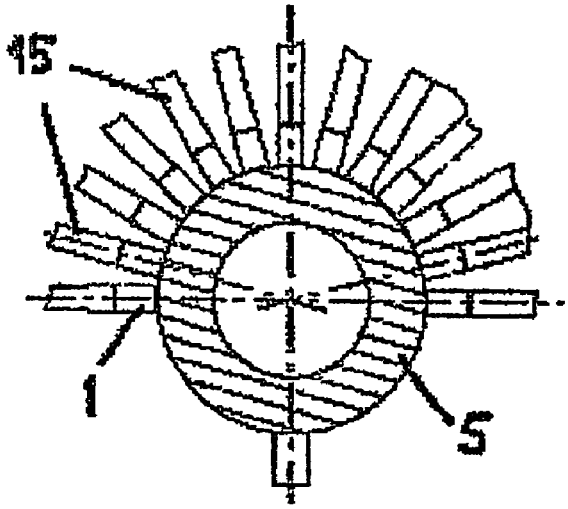
FIG. 5 shows a sectional view of a collector 5 according to the invention including pipe nipples 1 made of a nickel-based alloy and having welded thereto steam generator connecting ducts 15.
Figure 4:
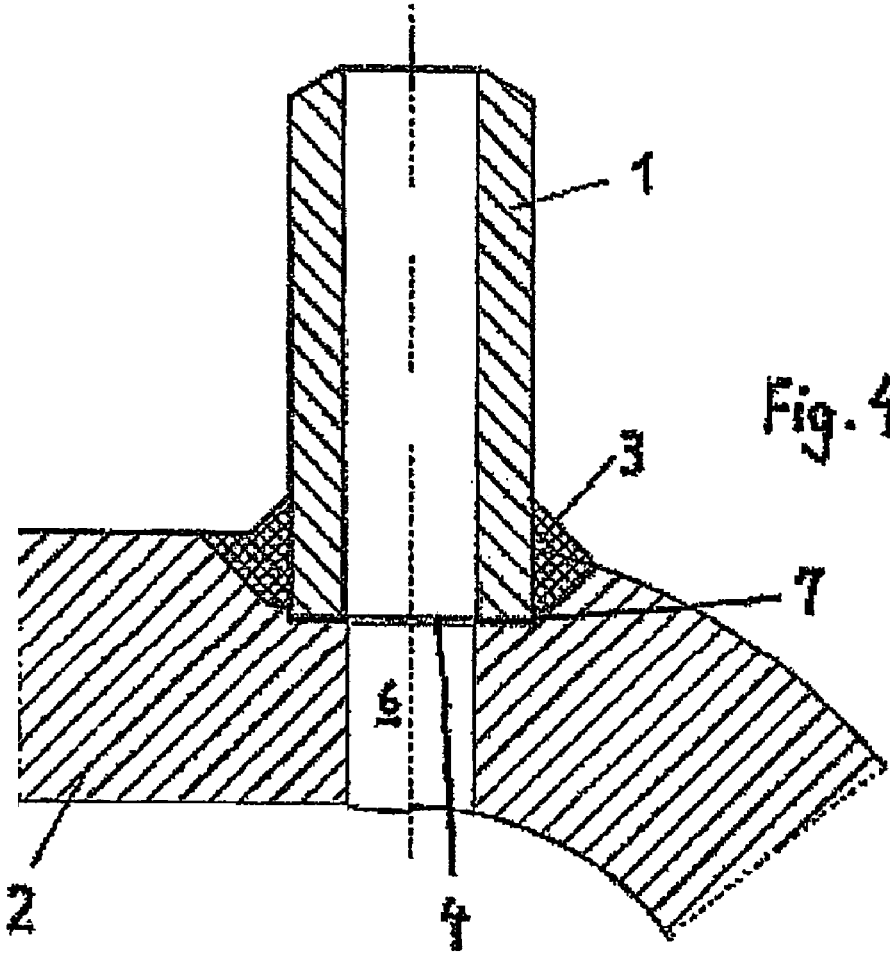
In FIG. 4 may be seen a sectional view of a weld connection according to the invention between a collector wall 2 and a pipe nipple 1.

As is particularly apparent from FIG. 4, the cylindrical pipe nipple 1 made of nickel-based alloy, which is continuously cylindrical, has been so inserted into the outer section 7 of enlarged diameter of a stepped connecting bore 6 and been welded to the vessel wall 2 by means of a fillet weld 3 that an axial gap 4 is retained as an expansion gap between the innermost end face of the pipe nipple 1 and the angular bottom of the outer section 7 of the connecting bore 6. The steam generator connecting ducts 15 may, in accordance with FIG. 5, be welded directly onto the pipe nipples 1. As a result, for each of the connecting ducts 15 only two welding seams are necessary, of which the welding seam 3 is positioned directly at the transition from the nickel-based alloy of pipe nipple 1 to the vessel wall 2.

Instead of a martensitic or ferritic material for the wall 2 or the vessel, the latter itself may be composed of a material made of a nickel-based alloy.

Figure 6:
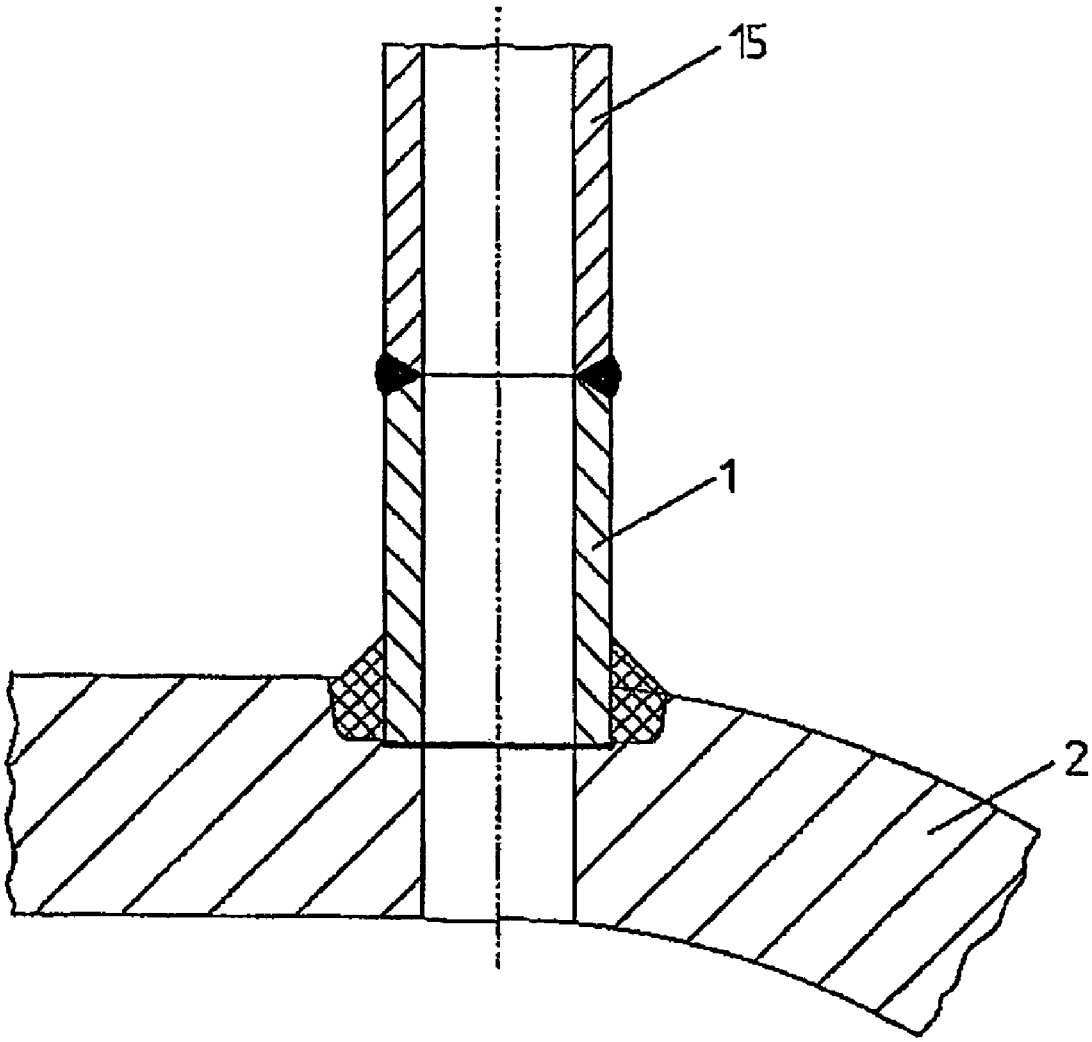
FIG. 6 shows a sectional view of a welding connection according to the invention between pipe nipples (1) and the vessel wall (2) on the one hand and pipe nipples (1) and the connecting duct (15) on the other hand.

As shown in FIG. 6, in amplification of FIG. 4, the pipe nipple (1) is welded to the connecting duct (15), there being used as the welding material for the welding connection according to the invention between the pipe nipple 1 and the vessel wall on the one hand, and/or pipe nipple (1) and connecting duct (15) on the other hand, preferably a material is used such that its co-efficient of expansion has a value between the co-efficient of expansion of the pipe nipple material and the co-efficient of expansion of the vessel material, respectively the connecting duct. For welding the pipe nipple to the vessel wall respectively the pipe nipple to the connecting duct, a welding material may also be used, the co-efficient of expansion of which corresponds to that of the pipe nipple. After welding together the components pipe nipple and vessel wall or pipe nipples and connecting ducts, the co-efficient of expansion of the weld connection will be intermediate between the co-efficient of expansion of the two materials to be connected because of the mixing together of the respective materials.

The invention claimed is:

1. Process for establishing a connection between steam generator heating surfaces of austenitic material and a vessel (5); employed as a collector (5, 17) or as a distributor comprising:

installing pipe nipples (1) between connecting ducts (15) leading to the steam generator heating surface and a collector or vessel wall (2) of a basic body of the vessel (5) and welding the pipe nipples (1) in each case with the formation of an axial gap (4) between the vessel wall (2) and the pipe nipple (1) at one end directly to the vessel wall (2) and at the other end to the connecting duct (15), wherein the pipe nipples (1) are each inserted into the outer section (7) of a stepped connecting bore (6) of the vessel wall (2) and in each case one pipe nipple (1) of a nickel-based alloy is welded to the vessel wall (2) of a basic body (5) of a martensitic or ferritic material or a nickel-based alloy and welded to a connecting duct (15) of austenitic material.

2. Process according to claim 1, wherein, as a welding material for the welding of pipe nipples (1) to the vessel wall (2), a welding material is employed, the co-efficient of expansion of which equals the co-efficient of expansion of the nipple material or has a value intermediate between the co-efficient of expansion of the nipple material and the coefficient of expansion of the vessel material.

3. Process according to claim 1, wherein a welding material is employed for welding together pipe nipples (1) and a connecting duct (15), the coefficient of expansion of which equals the co-efficient of expansion of the nipple material or has a value intermediate between the co-efficient of expansion of the nipple material and the co-efficient of expansion of the connecting duct.

4. Vessel (5) forming a collector (5, 17) or distributor including pipe nipples (1) inserted into a vessel wall (2) of a vessel basic body (5) with the formation of an axial gap (4) between the vessel wall (2) and the respective pipe nipple (1), which pipe nipples (1), at one end, are welded directly to the vessel wall (2) with the formation of a welding seam (3) and, at the other end, can be welded each to an austenitic connecting duct (15) leading to a steam generator heating surface, wherein the pipe nipples (1) are each inserted into the outer section (7) of a stepped connecting bore formed in the vessel wall (2) and the vessel basic body (5) consists of a martensitic or ferritic material or a nickel-based alloy and the pipe nipples (1) consist of a nickel-based alloy.

5. Vessel according to claim 4, wherein the welding seam (3) is produced of a welding material having a co-efficient of expansion equal to the co-efficient of expansion of the nickel-based alloy of the pipe nipples (1) or has a value intermediate between the co-efficient of expansion of the nickel-based alloy of the pipe nipple (1) and the co-efficient of expansion of the material of the vessel wall (2).

* * * * *